US009833371B2

(12) United States Patent
Purdy et al.

(10) Patent No.: US 9,833,371 B2
(45) Date of Patent: Dec. 5, 2017

(54) SYSTEM AND METHOD FOR PATIENT TURNING AND REPOSITIONING WITH SIMULTANEOUS OFF-LOADING OF THE BONY PROMINENCES

(71) Applicant: MOLNLYCKE HEALTH CARE AB, Gothenburg (SE)

(72) Inventors: William Purdy, White Plains, NY (US); Robert Purdy, Bedford, NY (US)

(73) Assignee: MOLNLYCKE HEALTH CARE AB, Gothenburg (SE)

( * ) Notice: Subject to any disclaimer, the term of this patent is extended or adjusted under 35 U.S.C. 154(b) by 703 days.

(21) Appl. No.: 13/834,911

(22) Filed: Mar. 15, 2013

(65) Prior Publication Data

US 2013/0198950 A1 Aug. 8, 2013

Related U.S. Application Data

(63) Continuation-in-part of application No. 13/493,582, filed on Jun. 11, 2012, now Pat. No. 9,504,621.
(Continued)

(51) Int. Cl.
*A61G 7/10* (2006.01)
*A61G 7/00* (2006.01)
(Continued)

(52) U.S. Cl.
CPC ..... *A61G 7/1026* (2013.01); *A61G 7/001* (2013.01); *A61G 7/05792* (2016.11);
(Continued)

(58) Field of Classification Search
CPC .. A61G 7/1021; A61G 7/1023; A61G 7/1025; A61G 7/1026; A61G 1/01;
(Continued)

(56) References Cited

U.S. PATENT DOCUMENTS 2,466,142 A 4/1949 Yost
2,489,828 A 11/1949 Springer
(Continued)

FOREIGN PATENT DOCUMENTS

GB 2300845 A1 11/1996
IN 5020/DELNP/2006 8/2007
(Continued)

OTHER PUBLICATIONS

U.S. Appl. No. 13/493,641, Non-Final Office Action, dated Jun. 1, 2016, 15 pages.
(Continued)

*Primary Examiner* — David E Sosnowski
*Assistant Examiner* — David R Hare
(74) *Attorney, Agent, or Firm* — Kilpatrick Townsend & Stockton LLP

(57) ABSTRACT

The present invention relates to a system and method for sacral and trochanteric support and off-loading. The system provides a ultra low pressure plenum and a positioner. The patient body size and size and corresponding surface area of the positioner control the amount of gas which is displaced evenly against the walls of the ultra low pressure plenum to allow the combination of the ultra low pressure plenum and the positioner to slightly lift a patient from a bed surface, thereby offloading the sacrum and trochanter. The positioner can be an ultra low pressure bladder.

18 Claims, 20 Drawing Sheets

Related U.S. Application Data

(60) Provisional application No. 61/614,791, filed on Mar. 23, 2012, provisional application No. 61/495,085, filed on Jun. 9, 2011.

(51) Int. Cl.
*A61G 1/01* (2006.01)
*A61G 7/057* (2006.01)

(52) U.S. Cl.
CPC ..... *A61G 7/109* (2013.01); *A61G 7/1021* (2013.01); *A61G 7/1023* (2013.01); *A61G 7/1025* (2013.01); *A61G 1/01* (2013.01); *A61G 7/05753* (2013.01); *A61G 7/05776* (2013.01)

(58) Field of Classification Search
CPC ..... A61G 7/001; A61G 7/1051; A61G 7/109; A61G 7/05792; A61G 7/05753; A61G 7/05776
USPC ..... 5/81.1 R, 81.1 HS, 81.1 T, 89.1
See application file for complete search history.

(56) References Cited

U.S. PATENT DOCUMENTS 2,748,399 A 6/1956 Rockoff
3,158,875 A 12/1964 Fletcher
3,331,087 A * 7/1967 Barlow ..... 5/81.1 T
3,526,908 A * 9/1970 Davis ..... 5/81.1 T
3,762,404 A 10/1973 Sakita
4,005,498 A * 2/1977 Starr et al. ..... 5/81.1 R
4,024,861 A 5/1977 Vincent et al.
4,211,218 A 7/1980 Kendrick
4,272,856 A * 6/1981 Wegener et al. ..... 5/81.1 T
4,428,087 A 1/1984 Horn
4,472,847 A 9/1984 Gammons et al.
4,517,690 A 5/1985 Wegener
4,566,445 A 1/1986 Jelsma et al.
4,665,908 A 5/1987 Calkin et al.
4,736,474 A 4/1988 Moran et al.
4,977,629 A 12/1990 Jones
5,044,031 A 9/1991 Sherwood et al.
5,060,324 A 10/1991 Marinberg et al.
5,065,464 A 11/1991 Blanchard et al.
5,067,189 A 11/1991 Weedling et al.
5,092,007 A * 3/1992 Hasty ..... 5/715
5,103,518 A 4/1992 Gilroy et al.
5,121,756 A 6/1992 Koledin
5,421,874 A 6/1995 Pearce
5,489,259 A 2/1996 Jacobs et al.
5,549,743 A 8/1996 Pearce
5,626,150 A 5/1997 Johnson et al.
5,626,657 A 5/1997 Pearce
5,708,999 A 1/1998 Priolo et al.
5,806,796 A 9/1998 Healey
5,869,164 A 2/1999 Nickerson et al.
5,966,763 A 10/1999 Thomas et al.
6,020,055 A 2/2000 Pearce
6,073,291 A 6/2000 Davis
6,110,006 A 8/2000 Chen
6,119,292 A 9/2000 Haas
6,128,796 A 10/2000 McCormick et al.
6,145,143 A 11/2000 Hicks et al.
6,151,739 A 11/2000 Meyer et al.
6,154,900 A * 12/2000 Shaw ..... A61G 7/001 5/615
6,175,980 B1 1/2001 Gaither et al.
6,197,099 B1 3/2001 Pearce
6,209,159 B1 4/2001 Murphy et al.
6,318,372 B1 11/2001 Hiebert et al.
6,343,385 B1 2/2002 Katz
6,351,863 B1 3/2002 Meyer et al.
6,381,787 B1 * 5/2002 Rogone ..... A47D 13/08 5/420
6,397,419 B1 6/2002 Mechache
6,421,859 B1 7/2002 Hicks et al.
6,425,399 B1 * 7/2002 Hoster, Jr. ..... A61F 5/05816 128/869
6,498,198 B2 12/2002 Pearce
6,588,511 B1 7/2003 Kriesel et al.
6,604,252 B1 8/2003 Lee et al.
6,701,544 B2 3/2004 Heimbrock
6,718,584 B2 4/2004 Rabaiotti et al.
6,823,549 B1 11/2004 Hampton et al.
6,857,151 B2 2/2005 Jusiak et al.
6,896,065 B2 5/2005 Kriesel et al.
6,986,170 B2 1/2006 Nelson
7,007,330 B2 3/2006 Kuiper et al.
7,032,261 B2 4/2006 Heimbrock
7,055,190 B2 6/2006 Barth et al.
7,065,815 B2 6/2006 Buchanan
7,080,422 B2 * 7/2006 Ben-Levi ..... A61G 7/001 5/615
7,146,660 B2 12/2006 Heimbrock
7,200,956 B1 4/2007 Kotha et al.
7,243,382 B2 7/2007 Weedling et al.
7,266,852 B2 9/2007 Davis
7,340,785 B2 3/2008 Weedling et al.
7,360,543 B1 4/2008 Coleman et al.
7,415,738 B2 8/2008 Weedling et al.
7,424,760 B2 * 9/2008 Chaffee ..... 5/644
7,464,422 B2 * 12/2008 Townsend ..... A61G 7/001 5/615
7,467,431 B2 12/2008 Weedling et al.
7,559,103 B2 7/2009 Barth et al.
7,565,710 B2 7/2009 Chambers et al.
7,591,029 B2 9/2009 Weedling et al.
7,650,654 B2 1/2010 Lambarth et al.
7,681,262 B2 3/2010 Weedling et al.
7,725,963 B2 6/2010 Johnson
7,739,758 B2 6/2010 Weedling et al.
7,832,039 B2 11/2010 Chambers et al.
7,900,299 B2 * 3/2011 Weedling et al. ..... 5/81.1 R
7,904,971 B2 3/2011 Doria et al.
7,945,979 B1 5/2011 Lin
8,001,636 B2 8/2011 Nissen et al.
8,171,585 B2 5/2012 Mead et al.
8,191,188 B2 6/2012 Kaplan et al.
8,234,727 B2 8/2012 Schreiber et al.
8,261,388 B1 9/2012 Gill et al.
8,302,222 B2 11/2012 Jasani
8,418,296 B1 4/2013 Hanlon et al.
8,566,977 B2 10/2013 Davis
8,661,580 B2 3/2014 Giap
8,667,631 B2 3/2014 Coates et al.
8,701,225 B1 * 4/2014 Latiff ..... 5/81.1 T
8,756,725 B2 6/2014 Piegdon et al.
8,789,533 B2 7/2014 Steffens et al.
8,850,634 B2 10/2014 Ponsi et al.
8,858,478 B2 10/2014 Purdy et al.
8,898,833 B2 12/2014 Coates et al.
8,984,681 B2 3/2015 Ponsi
9,149,402 B2 10/2015 Gomez et al.
2002/0104535 A1 8/2002 Biondo et al.
2002/0144343 A1 10/2002 Kuiper et al.
2003/0192123 A1 10/2003 Chaffee
2003/0200611 A1 10/2003 Chaffee
2004/0083550 A1 5/2004 Graebe, Jr. et al.
2005/0028273 A1 2/2005 Weedling et al.
2006/0037136 A1 2/2006 Weedling et al.
2006/0179577 A1 8/2006 Chaffee
2007/0118993 A1 5/2007 Bates
2007/0283496 A1 12/2007 Skripps et al.
2008/0083067 A1 4/2008 Wheeldon-Glazener
2008/0134442 A1 6/2008 Hui
2008/0201855 A1 8/2008 Groves et al.
2009/0106893 A1 4/2009 Blevins
2009/0271928 A1 11/2009 Tishby
2010/0096419 A1 4/2010 Stephens et al.
2010/0170037 A1 7/2010 Fletcher et al.
2011/0220695 A1 9/2011 Saunders et al.
2011/0241300 A1 10/2011 Schioler et al.
2011/0271444 A1 11/2011 Davis
2012/0011658 A1 1/2012 Weedling et al.

(56) References Cited

U.S. PATENT DOCUMENTS

| | | | | |
|---|---|---|---|---|
| 2012/0049605 | A1 | 3/2012 | Sanefuji et al. | |
| 2012/0079656 | A1 | 4/2012 | Lewis et al. | |
| 2012/0186587 | A1 | 7/2012 | Steffens et al. | |
| 2012/0284923 | A1 | 11/2012 | Jensen et al. | |
| 2012/0311781 | A1 | 12/2012 | Purdy et al. | |
| 2012/0311788 | A1 | 12/2012 | Jackson et al. | |
| 2013/0061396 | A1 | 3/2013 | Lafleche et al. | |
| 2013/0145559 | A1 | 6/2013 | Purdy et al. | |
| 2013/0152950 | A1 | 6/2013 | Giap | |
| 2013/0180046 | A1 | 7/2013 | Davis et al. | |
| 2013/0205495 | A1 | 8/2013 | Ponsi et al. | |
| 2013/0230685 | A1 | 9/2013 | Smith | |
| 2013/0276235 | A1 | 10/2013 | Kenalty et al. | |
| 2013/0340770 | A1* | 12/2013 | Starr | A47D 13/02 128/870 |
| 2014/0007353 | A1 | 1/2014 | Stryker et al. | |
| 2014/0041114 | A1 | 2/2014 | Davis | |
| 2014/0075673 | A1 | 3/2014 | Weedling et al. | |
| 2015/0052685 | A1 | 2/2015 | Bhat et al. | |
| 2015/0101126 | A1 | 4/2015 | Reiners et al. | |
| 2015/0128341 | A1 | 5/2015 | Kuiper | |
| 2015/0135443 | A1 | 5/2015 | Cortez | |
| 2015/0157521 | A1 | 6/2015 | Williams et al. | |
| 2015/0238378 | A1 | 8/2015 | Bhat et al. | |
| 2015/0290848 | A1 | 10/2015 | Sanefuji et al. | |
| 2016/0067126 | A1 | 3/2016 | Purdy et al. | |

FOREIGN PATENT DOCUMENTS

| | | |
|---|---|---|
| WO | 0137774 | 5/2001 |
| WO | 2014043525 | 3/2014 |
| WO | 2015057775 | 4/2015 |
| WO | 2015128618 | 9/2015 |
| WO | 2015130703 | 9/2015 |
| WO | 2016037108 | 3/2016 |

OTHER PUBLICATIONS

Blue Chip Medical Products, Inc., Power Pro Elite® Mattress System—Model 9500, retrieved from the internet at https://web.archive.org/web/20100501171106/http://www.bluechipmedical.com/mattress-systems/air-mattress/power-pro-elite, at least as early as May 1, 2010, 4 pages.

EZ Way, Inc., EZ Matt, retrieved from the internet at https://web.archive.org/web/20090202082654/http://ezlifts.com/products/product_details.cfm?ProductID=27, at least as early as Feb. 2, 2009, 1 page.

Hill-Rom®, AirPal® Patient Air Lift, retrieved from the internet at https://web.archive.org/web/20101015045524/http://www.hill-rom.com/usa/AirPal.htm, at least as early as Oct. 15, 2010, 1 page.

Hill-Rom®, AirPal® Patient Transfer System, Dec. 22, 2008, http://www.discovermymobility.com/store/patient-lifts/hill-rom/hill-rom-patient-transfer-system.pdf, 2 pages.

HoverTech, HoverMatt® Air Transfer System, retrieved from the internet at https://web.archive.org/web/20110208085745/http://www.hovermatt.com/reusable, at least as early as Feb. 8, 2011, 1 page.

McAuley Medical, Inc., AirSlide for lateral transfer in-service video, uploaded to internet on Mar. 14, 2009, https://www.youtube.com/watch?v=u0tjtK_4gOE.

MDI—Medical Devices International, EMS Immobile-VAC™, retrieved from the internet at https://web.archive.org/web/20081120122715/http://www.mdimicrotek.com/prod_ems-immobilevac.htm, at least as early as Nov. 20, 2008, 5 pages.

Smart Medical Technology, Inc.®, Liftaem™—Revolutionary Lateral Patient Transfer Device, uploaded to internet on Apr. 4, 2008, https://www.youtube.com/watch?v=K7_9XA-dS5k.

Stryker, Stryker Glide Lateral Air Transfer System, 2009, https://www.stryker.com/stellent/droups/public/documents/web_content/glidespecsheetrevd.pdf, 2 pages.

Sundance Enterprises, Inc., Healthcare Products, The DAP 210 Static Overlay Mattress, retrieved from the internet at https://web.archive.org/web/20061014205929/http://sundancesolutions.com/dap210.php, at least as early as Oct. 14, 2006, 2 pages.

Sundance Enterprises, Inc., Healthcare Products, The DAP Series, Static Air Support System and Fluidized Positioners, retrieved from the internet at https://web.archive.org/web/20061013091949/http://sundancesolutions.com/healthcareproducts.php, at least as early as Oct. 13, 2006, 1 page.

International Patent Application No. PCT/US2015/048642, International Search Report and Written Opinion, dated Dec. 2, 2015, 8 pages.

U.S. Appl. No. 13/493,582, Non-Final Office Action, dated Aug. 26, 2015, 10 pages.

U.S. Appl. No. 13/493,582, Non-Final Office Action, dated Feb. 29, 2016, 17 pages.

U.S. Appl. No. 13/493,641, Non-Final Office Action, dated Sep. 9, 2015, 7 pages.

* cited by examiner

SYSTEM AND METHOD FOR PATIENT TURNING AND REPOSITIONING WITH SIMULTANEOUS OFF-LOADING OF THE BONY PROMINENCES

CROSS REFERENCE TO RELATED APPLICATION

This application is a continuation-in-part of U.S. patent application Ser. No. 13/493,582 filed Jun. 11, 2012, which claims the benefit of U.S. Provisional Patent Application No. 61/614,791 filed Mar. 23, 2012 and U.S. Provisional Patent Application No. 61/495,089 filed on Jun. 9, 2011, the entireties of which applications are hereby incorporated by reference into this application.

BACKGROUND OF THE INVENTION

1. Field of the Invention

The present invention relates to a patient support which can be used in a bed or flat surface and in particular to a system and method for sacral and trochanteric support which can be used for turning and repositioning of a patient in a bed or on a flat surface.

2. Description of Related Art

Hospital bed and other patient static air and dynamic air supports are known. Typically, such patient supports are used to provide a support surface for patients or other individuals for treatment, recuperation, or rest and prevention of skin breakdown.

It is desirable to provide an improved support for sacral and trochanteric off-loading and other bony prominences such as scapula, ishial tuberocities.

SUMMARY OF THE INVENTION

The present invention relates to a system and method for sacral and trochanteric support and off-loading. It is optimal to barely elevate the sacrum and trochanter from the surface of the bed. The system provides a ultra low pressure plenum and a positioner. The ultra low pressure plenum can include one or more air chambers. The air chamber is filled at a predetermined low pressure for distributing pressure along the length of the ultra low pressure plenum, but not providing significant elevation of a received body part by itself.

A cover can be received over the ultra low plenum. The cover can include a retaining member for receiving the positioner. The cover can include a temperature regulating material for keeping the received body part in an optimal range of skin temperature to keep comfortable longer. In one embodiment, a phase change material can be used for adjusting the temperature of the system to adapt to temperature changes of the body.

The positioner includes a bladder preferably filled with a fluidized particulate material with sufficient size and shape to displace an amount of air in the support to offload pressure being from a received body part, such as, but not limited to, the bony prominences of the sacrum and trochanter including and any vulnerable bony prominences. The positioner can be placed at a lower position of the ultra low pressure plenum to displace air from the lower position of the ultra low pressure plenum to an upper position of the ultra low pressure plenum. The surface area of the positioner provides greater positive air displacement than would occur from the body part of the patient by itself. In one embodiment, the positioner can have a greater width than the patient.

Alternatively, the positioner can be an ultra low pressure bladder. The positioner has the advantages of increasing the pneumatic assist when turning. The positioner also stabilizes the body of a user to prevent the body from twisting and attenuates the interface pressure after the legs are placed on the lower position of the ultra low pressure plenum. The positioner displaces air in lower position of the ultra low pressure plenum to an upper position of the ultra low pressure plenum and to places of the ultra low pressure plenum that have less resistance, such as the lumbar spine and the sides of the ultra low pressure plenum that are not bearing weight from a body received on the ultra low pressure plenum. The positioner provides three dimensional movement and dramatically reduces shear forces on the sacrum.

In one embodiment, the ultra low pressure plenum includes a lower bladder section having a smaller width dimension than an upper bladder section. The air chambers of the lower bladder section and the upper bladder section being in air communication with one another. Air is communicated within the upper bladder section and lower bladder section through air displacement. The patient body size and size and corresponding surface area of the positioner control the amount of air which is displaced evenly against the walls of the ultra low pressure plenum to allow the combination of the ultra low pressure plenum and the positioner to slightly lift a patient from a bed surface, thereby offloading the sacrum and trochanter.

Preferably, the positioner has little or no flow characteristics unless an outside force is applied other than gravity. The positioner can displace and contour three dimensionally as though it was fluid while not having flow characteristics that would result in migration of the medium under the force of gravity. The positioner can provide three dimensional contouring. The positioner can be shaped as a pad.

The combination of the ultra low pressure plenum and positioner, including a fluidized medium, creates sufficient support of the received body part while responding to normal patient movement. The positioner can be placed adjacent the iliac crest and scapula along the spine to displace enough air to off load the greater trochanter that is currently bearing the weight of the body and should be placed proximal in a way to displace the air of the lower section of the bladder to offload the sacrum.

The ultra low pressure plenum can be low profile. In one embodiment, the system including the ultra low pressure plenum can be positioned underneath the sheets of bed, such as a hospital bed. Alternatively, the system including the ultra low pressure plenum can be placed above the sheets for aiding in patient turning and repositioning.

In one embodiment, the positioner can be positioned at one of outer walls of the support to push air away from the outer wall, thereby aiding in turning of a patient.

In one embodiment, a lower surface of the ultra low pressure plenum is formed of a material having a low coefficient of friction to allow the ultra low pressure plenum to be used to move a patient on a surface, such as a hospital bed. The upper surface of the ultra low pressure plenum and/or the lower surface of the positioner can be formed of a material having a high coefficient of friction to retain the positioner in place and prevent unwanted movement of the positioner while in use over the support. For example, the material can be a non-skid material. Gripping handles can be provided on either edge of the ultra low pressure plenum to aid in movement of the ultra low pressure plenum when a patient supported by the ultra low pressure plenum. In this embodiment, the gripping handles can be placed over the sheet and unweighted to allow the patient to be moved for turning and repositioning of the patient. In one embodiment, the gripping handles are holes in the cover. In an alternative embodiment, the gripping handles are placed under the sheet and have a high coefficient of friction to prevent movement of the ultra low pressure plenum.

In one embodiment, the system includes a three layer construction in which the layers are sealed to one another along the outside edges. The system provides a capacity for low air loss. Each of the layers form a plenum. Any of the layers can be perforated. A valve can be inserted through the appropriate layer for connection to an air flow. The other layers can be static plenums.

In one embodiment, the system includes a four layer construction in which the layers are sealed to one another along the outside edges. The system provides a first plenum formed between a top layer and a first intermediate layer. The first plenum can be fixed air chamber or a chamber providing low air loss. A second plenum is formed between a second intermediate layer and a bottom layer. The second plenum can provided alternating pressure. One or more valves can extend from the second plenum for attachment to a pneumatic device. The pneumatic device can be adjusted to provide alternating pressure for either sequential or intermittent therapies.

The invention will be more fully described by reference to the following drawings.

DETAILED DESCRIPTION

Figure 1A:
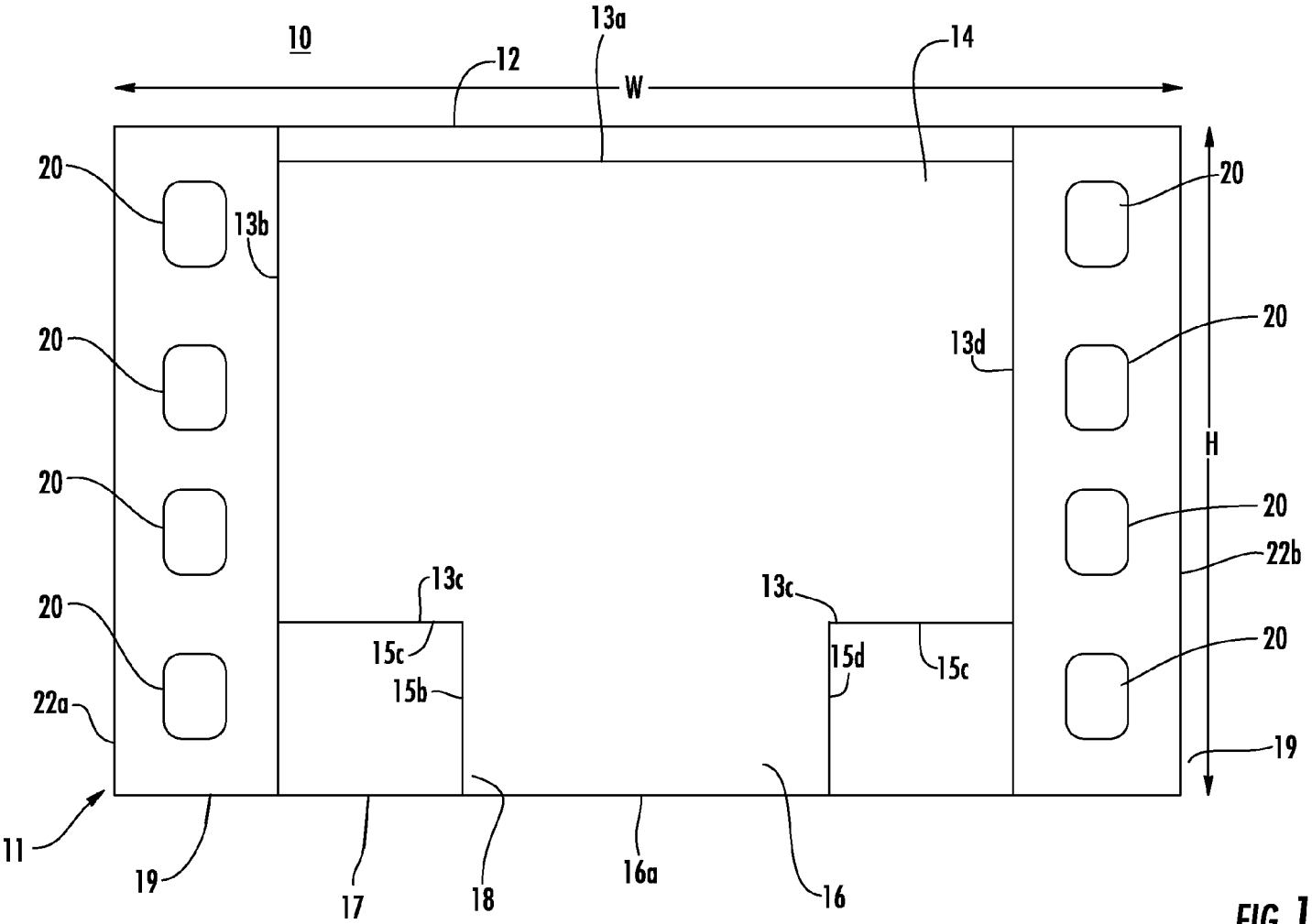
FIGS. 1A-1C are a schematic diagrams of a support used in a system for sacral and trochanteric support in accordance with the teachings of the present invention.

Reference will now be made in greater detail to a preferred embodiment of the invention, an example of which is illustrated in the accompanying drawings. Wherever possible, the same reference numerals will be used throughout the drawings and the description to refer to the same or like parts.

Figure 1B:
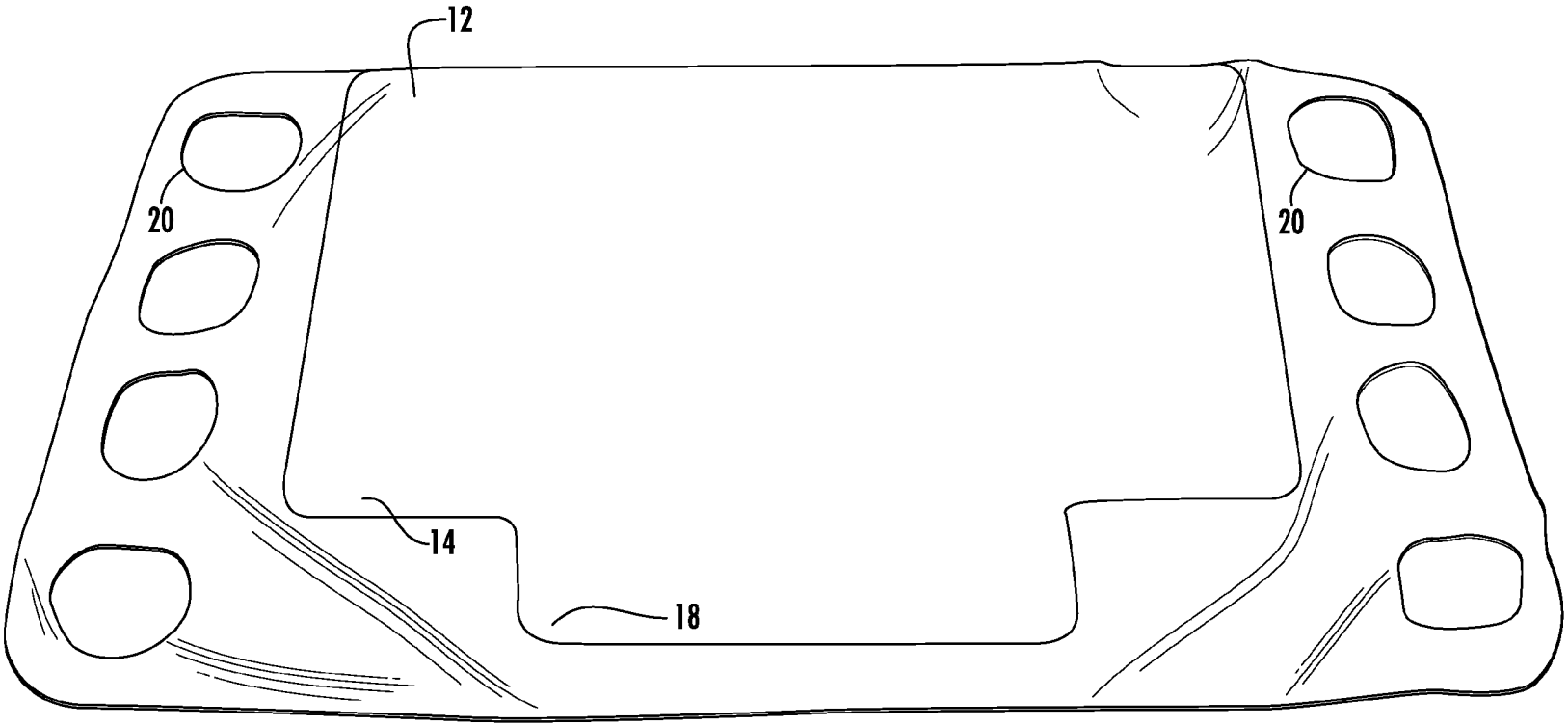
Figure 1C:
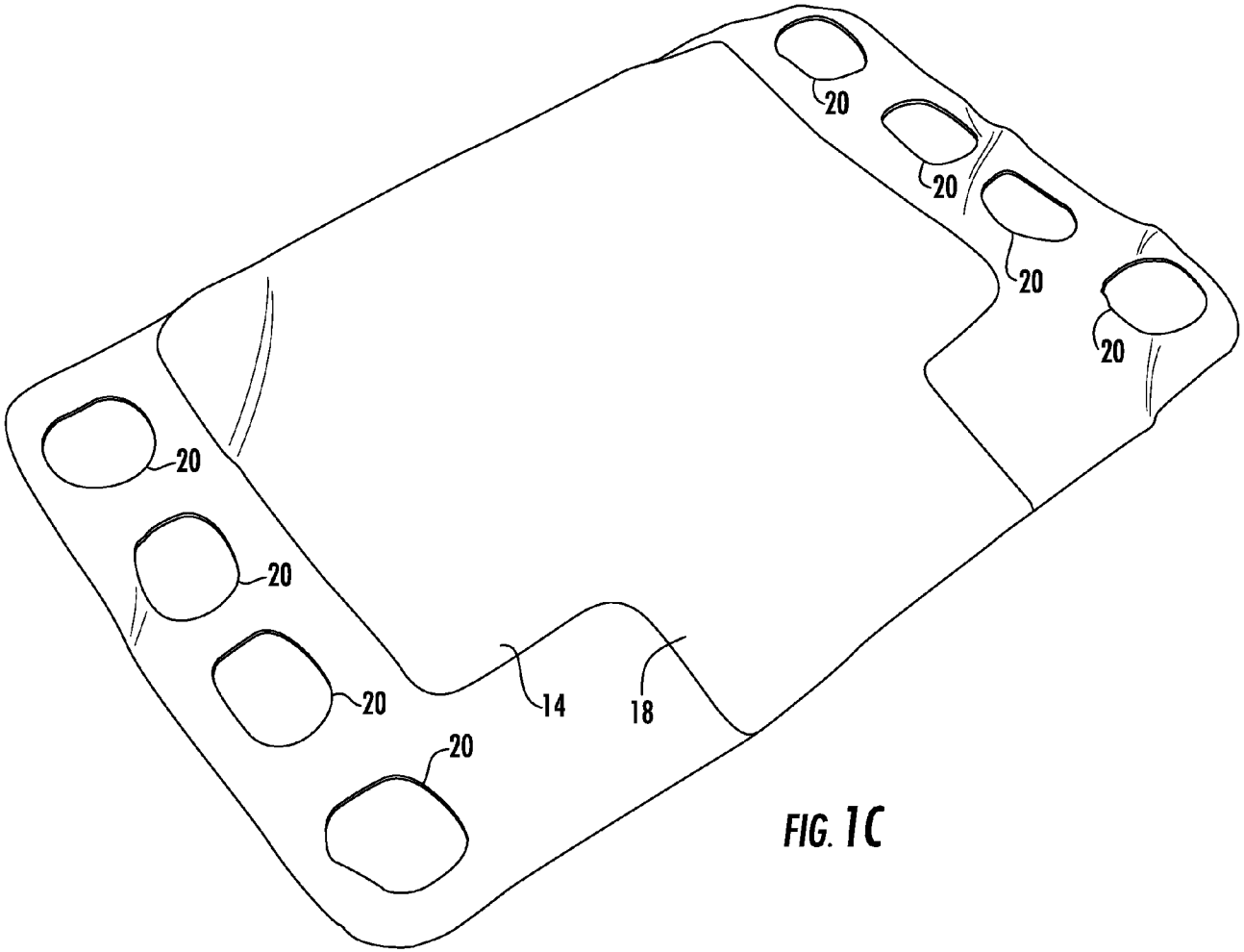
Figure 2:
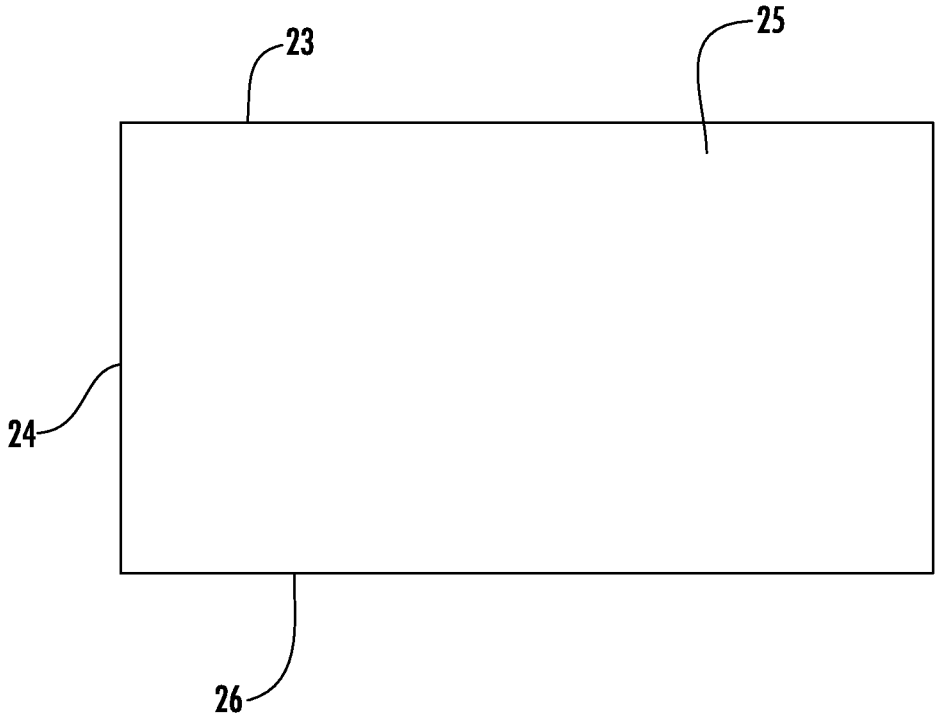
FIG. 2 is a schematic diagram of a positioner used in the system for sacral and trochanteric support.
Figure 3:
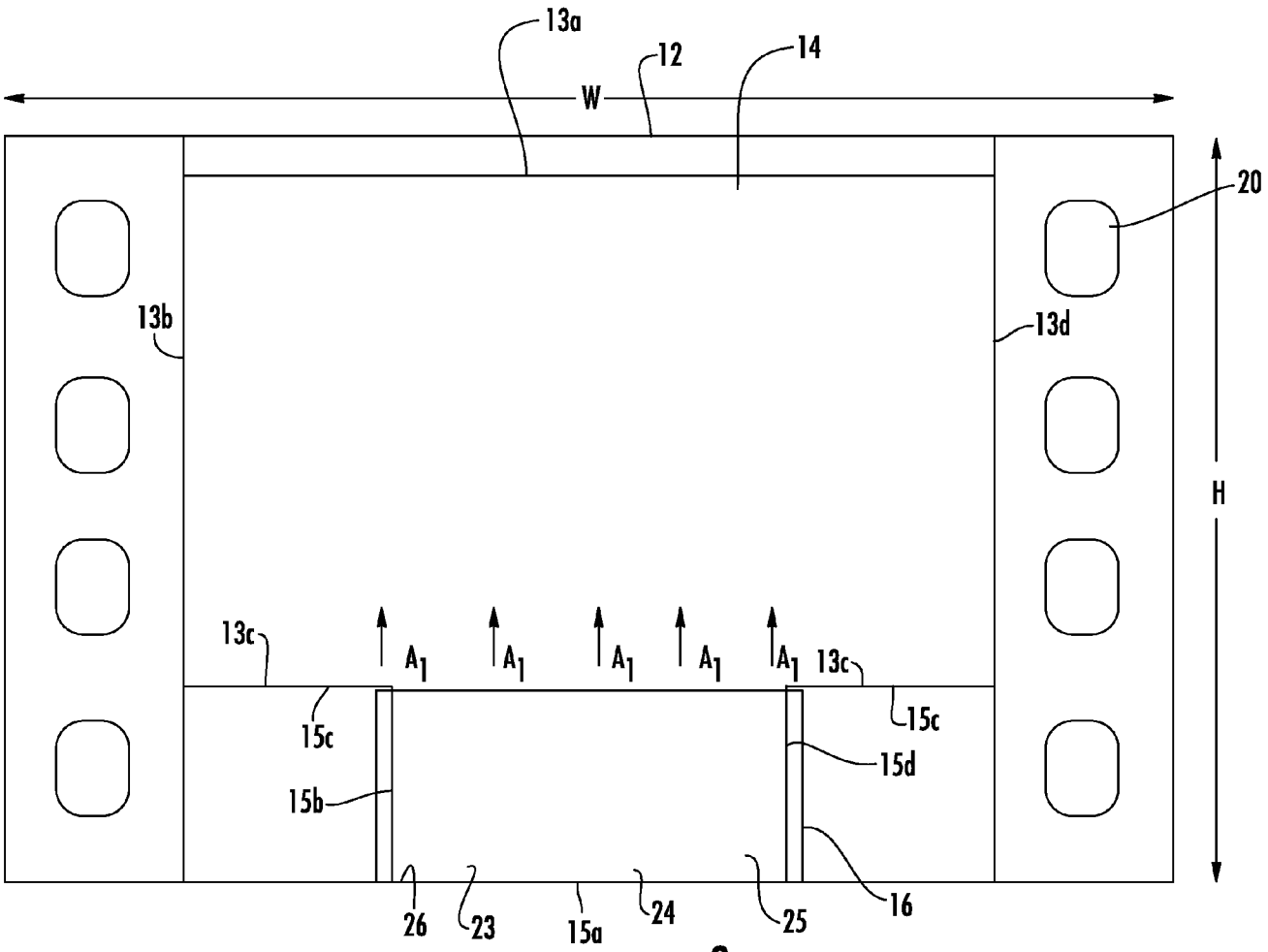
FIG. 3 is a schematic diagram of the system including the support and the positioner.

FIGS. 1-3 illustrate system for support of a body part of a patient turning and repositioning of the patient with simultaneous offloading of the bony prominences 10 in accordance with the teachings of the present invention. Base 11 has ultra low pressure plenum 12 coupled or integral therewith. Ultra low pressure plenum 12 is configured to a shape to fit underneath a patient and support the lower back and/or hips of a patient. For example, ultra low pressure plenum 12 can have a width W of approximately 52 inches, and a height H of about 35 inches. Alternatively, width W can be a width of a bed, such as a hospital bed. Ultra low pressure plenum 12 is formed of upper bladder 14 and lower bladder 16. Lower bladder 16 has a smaller width dimension than upper bladder 14. Air pressure within upper bladder 14 and lower bladder 16 is reduced sufficiently for distributing pressure within ultra low pressure plenum 12, but is not providing support of the received body part by itself. Upper bladder section 14 extends between edges 13*a*-13*d*. Lower bladder section 16 extends between edges 15*a*-15*d*.

Bottom surface 17 of ultra low pressure plenum 12 can be formed of a material having a low coefficient of friction to allow ultra low pressure plenum 12 to be used to move a patient on surface 19 underneath ultra low pressure plenum 12, such as a hospital bed. A suitable material having a low coefficient of friction is nylon or rip stop nylon material. Upper surface 18 of ultra low pressure plenum 12 can be formed of a material having a high coefficient of friction. A suitable material having a high coefficient of friction is a rubberized or non-skid material. Gripping handles 20 can be provided on either edge 22*a*, 22*b* of base 11 to aid in movement of ultra low pressure plenum 12 over surface 19.

Gripping handles 20 can be placed over a sheet of a bed and unweighted to allow the patient to be moved. In an alternative embodiment, gripping handles 20 are placed under the sheet and have a high coefficient of friction to prevent movement of ultra low pressure plenum 12.

Positioner 23 can include bladder 24, as shown in FIG. 2. Bladder 24 is filled with fluidized material 25 which can retain its shape after sculpting. The flowability or lubricity of fluidized material 25 can be increased by adding a lubricant or by the removal of air from the interstitial spaces or both. The preferred medium of fluidized material 25 is a particulate material that has been modified in such a way that it acts like a fluid.

Fluidized material 25 refers to a compound or composition which can be sculpted and retain its shape and has no memory or substantially no memory. The no memory or substantially no memory feature enables bladder 24 to increase in height and maintain support of a body part. Fluidized material 25 is made of a viscosity that will allow it to contour but not collapse under the weight of the body part.

At sea level, the normal interstitial air pressure would exceed about 760 millibars of mercury. This increases or decreases marginally as altitude varies. Depending on the nature of the particulate fluidized material 25, the pressure can be lowered below about 500 millibars to about 5 millibars, preferably, 350 millibars to about 5 millibars, while still maintaining the necessary flow characteristics of the product.

Fluidized material 25 can include compressible and non-compressible beads, such as polyethylene or polystyrene (PS) beads, expanded polyethylene (PE), crosslinked expanded polyethylene (PE), polypropylene (PP) pellets, closed cell foams, microspheres, encapsulated phase changing materials (PCM). The beads can be hard shelled or flexible. In one embodiment, the beads are flexible and air can be evacuated from the beads. In one embodiment, hard beads can be mixed with flexible beads in which air can be evacuated from the flexible beads. In an alternative embodiment, fluidized material 25 can a porous foam substance including pockets of interstitial air. In one embodiment, fluidized material 25 can be a polyurethane foam. The polyurethane foam can be open or closed cell and cut into small shapes such as spheres or blocks. For example, a sphere of polyurethane foam can have a size of 2 inches in diameter. For example, a block of polyurethane foam can be a 1×1×1 inch block.

Suitable examples of fluidized material 25 can be formed of a mixture of microspheres and lubricant. The microspheres can include hollow or gas-filled structural bubbles (typically of glass or plastic) with an average diameter of less than 200 microns. The composition flows and stresses in response to a deforming pressure exerted on it and the composition ceases to flow and stress when the deforming pressure is terminated. For example, fluidized material 25 can be formed of a product referred to as Floam™. A flowable compound comprising lubricated microspheres, including the compound itself, formulations for making the compound, methods for making the compound, products made from the compound and methods for making products from the compound as defined by U.S. Pat. Nos. 5,421,874, 5,549,743, 5,626,657, 6,020,055, 6,197,099 and 8,175,585, each of which is hereby incorporated by reference into this application. Bladder 24 provides micro-contouring because fluidized material 25 can respond three-dimensionally. Alternatively, bladder 24 is formed of any contouring medium, such as foam or gel which is sufficient to displace air within ultra low pressure plenum 12.

For example, bladder 24 can be formed of a flexible plastic, such as urethane. Upon removal of gas from fluidized material 25, bladder 24 flows concurrent with the flow of fluidized material 25 such that bladder 24 moves with movement of fluidized material 25. For example, the gas can be air, helium, hydrogen or nitrogen. Optionally, gas can communicate throughout the whole bladder for allowing maximum contouring and functional displacement of both the gas and the fluidized chamber thereby providing maximum contouring to a desired body part.

Bladder 24 is preferably filled with fluidized particulate material 25 with sufficient size and shape to displace an amount of gas in ultra low pressure plenum 12 to offload pressure from the received body part, such as the bony prominences of the sacrum and trochanter. Lower surface 26 of positioner 23 can be formed of a high friction material for preventing movement of positioner 23 over ultra low pressure plenum 12.

For example, the pressure in ultra low pressure plenum 12 can be below 20 mm of water. It will be appreciated that all equivalents such as mm Hg and PSI can be used for measuring the pressure within ultra low pressure plenum 12.

The pressure within ultra low pressure plenum 12 can be below about 20 mm of water if no positioner 23 is used or if an area of less than about 30% of ultra low pressure plenum 12 is covered by positioner 23. The pressure within ultra low pressure plenum 12 can be below about 10 mm of water if an area of between about 30% to about 60% of ultra low pressure plenum 12 is covered by positioner 23. The pressure within ultra low pressure plenum 12 can be below about 5 mm of water if an area of greater than about 60% of ultra low pressure plenum 12 is covered by positioner 23.

Positioner 23 can be placed over lower bladder 16 of ultra low pressure plenum 12 to displace gas from lower bladder 16 to upper bladder 14 in the direction of arrows $A_1$, as shown in FIG. 3. When a patient is recumbent on ultra low pressure plenum 12 with their sacrum received on positioner 23, gas will be displaced in upper bladder 14 towards outer edges 13*a* for providing support adjacent to edges 13*b* and 13*d* thereby providing support of edges 13*b* and 13*d* of upper bladder 14 of the patient within edges 13*b* and 13*d* and lifting a patient from surface 11 and offloading the sacrum and trochanter.

Figure 4:
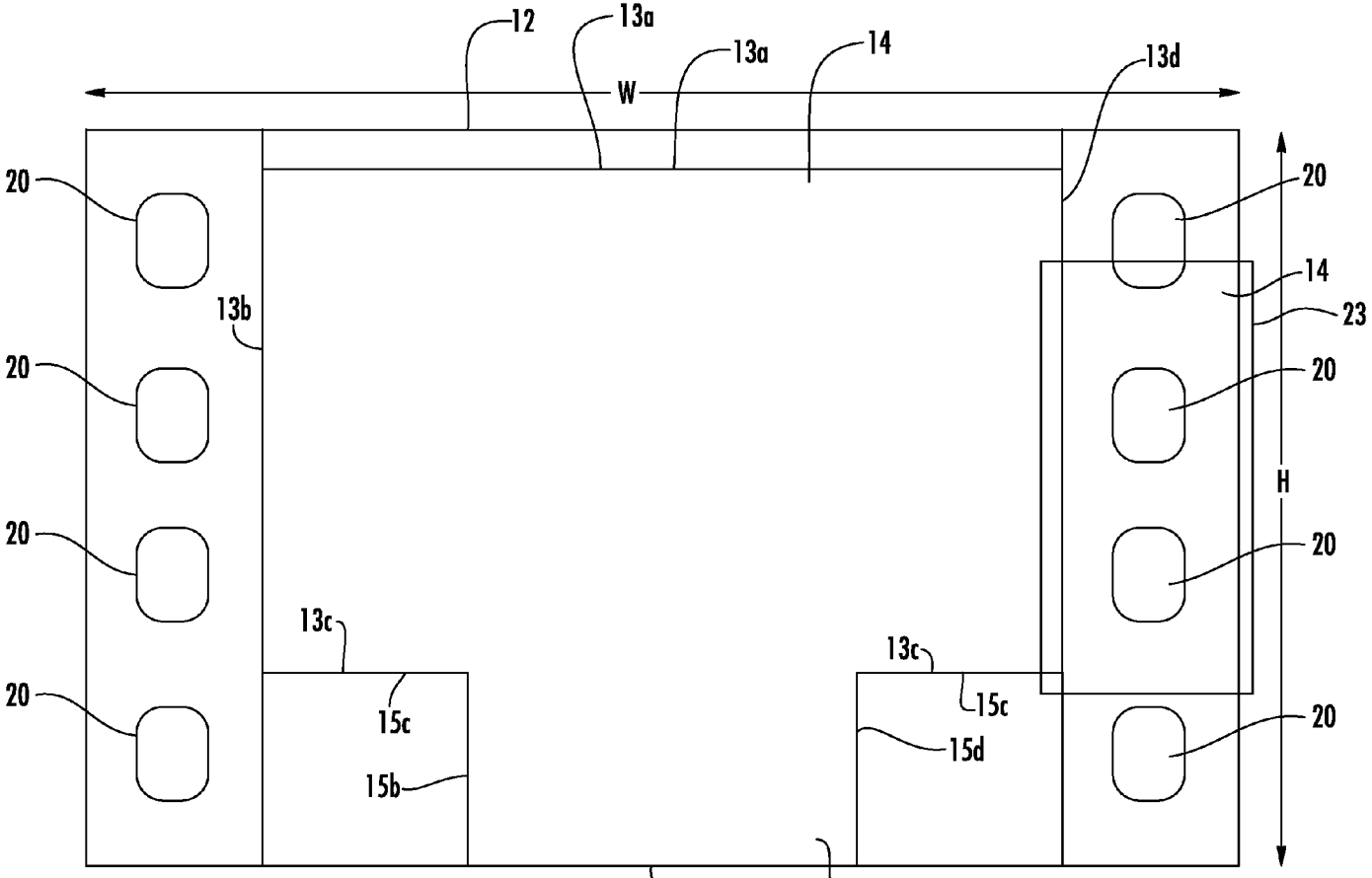
FIG. 4 is a schematic diagram of the system including the positioner positioned at an outer wall of the support.

In one embodiment, positioner 23 can be positioned at one of edges 13*b* and 13*d* to push air away from respective edges 13*b* and 13*d* thereby aiding in turning of a patient towards the opposite edge, as shown in FIG. 4. For example, if the patient is to be turned towards edge 13*d*, positioner 23 can be placed at edge 13*b* for displacing gas behind the patient to towards edge 13*b* of upper bladder 14, thereby pneumatically assisting in turning of the patient to face edge 13*d*.

System 10 including ultra low pressure plenum 12 is functional whether positioner 23 is placed on top of ultra low pressure plenum 12 or beneath ultra low pressure plenum 12.

Figure 5:
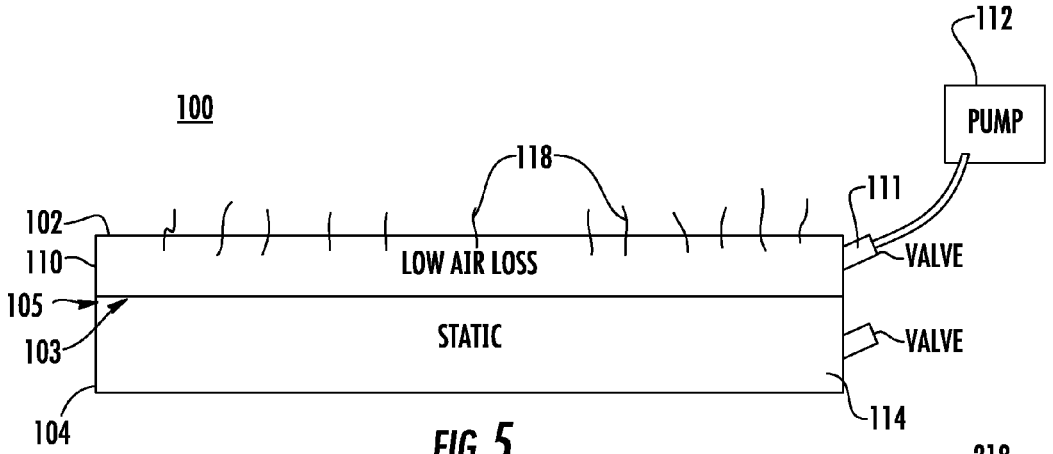
FIG. 5 is a schematic diagram of an alternate embodiment of a system for support of a body part in accordance with the teachings of the present invention which provides low pressure loss.

FIG. 5 illustrates an alternate embodiment of support of a body part 100. System 100 has a three layer construction. Top layer 102, intermediate layer 103 and bottom layer 104 are sealed to one another along outside edge 105. For example top layer 102 and bottom layer 104 can be formed of urethane.

Plenum 110 formed between top layer 102 and intermediate layer 103 can include dynamic air. Air 115 is pumped into plenum 110 through valve 111 by pump 112. Air 115 is pumped beneath top layer 102. Top layer 102 is perforated with apertures 118. Plenum 110 provides a dynamic amount of air to system 100 for adjusting the amount of air in plenum 114 and providing low air loss.

Plenum 114 formed between bottom layer 104 and intermediate layer 103 can include a fixed amount of static air. Valve 116 can be used to adjust the pressure in plenum 114. In one embodiment plenum 114 is filled with an ultra low pressure of a pressure of about 20 mm of water to about 5 mm of water or in some cases even lower pressures can be used.

Figure 6:
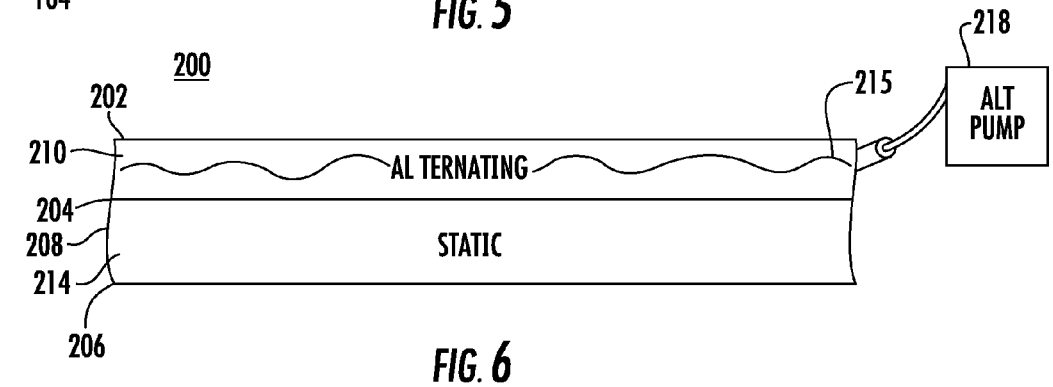
FIG. 6 is a schematic diagram of an alternate embodiment of a system support of a body part in accordance with the teachings of the present invention which provides alternating pressure.

FIG. 6 illustrates an alternate embodiment of support of a body part 200. System 200 has a three layer construction. Top layer 202, intermediate layer 204, and bottom layer 206 are sealed to one another along outside edge 208 for sealing each adjacent layer to one another. For example top layer 202, intermediate layer 204 and bottom layer 206 can be formed of urethane.

Plenum 210 is formed between sealed top layer 202 and intermediate layer 204. Plenum 210 can be formed as an alternating pressure pad. Air 215 is pumped into plenum 210 by pneumatic pump device 218. Pneumatic pump device 218 can be operated to pump air in either a sequential or intermittent manner for inflating or deflating plenum 214 to provide respective sequential or intermittent therapies.

Plenum 214 is formed between sealed bottom layer 206 and intermediate layer 204. Plenum 214 can include a fixed amount of static air. In one embodiment, plenum 214 is filled with an ultra low pressure of a pressure of less than about 20 mm of water to about 5 mm of water or in some cases even lower pressures can be used.

Figure 7:
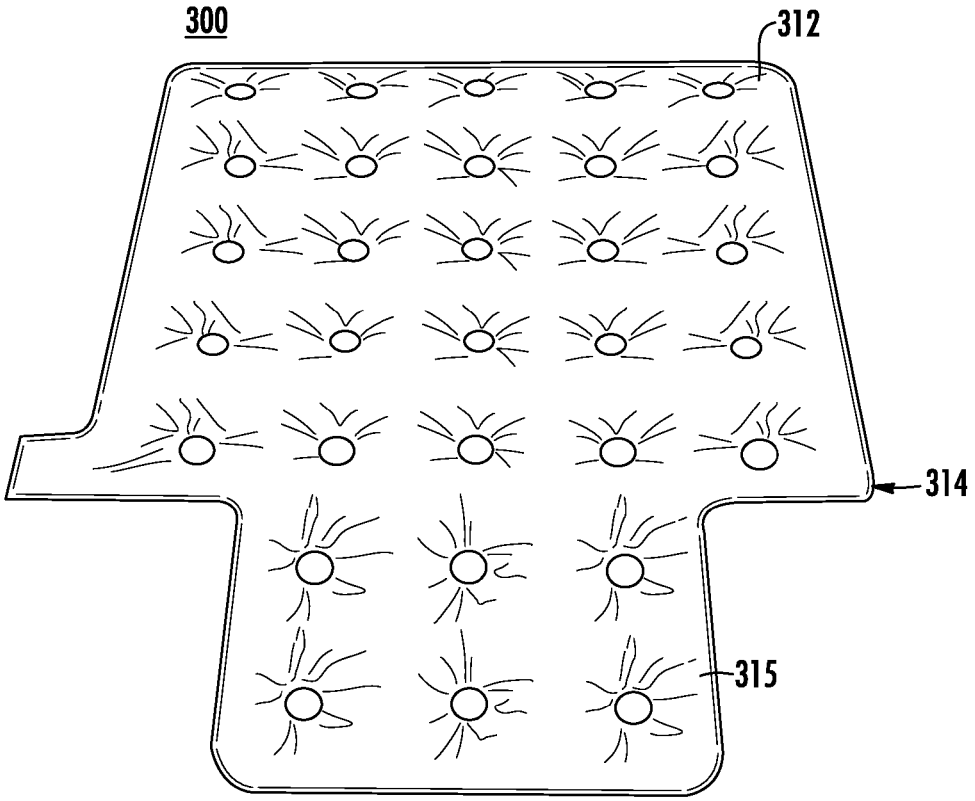
FIG. 7 is a schematic diagram of a support used in an alternate embodiment of a system for sacral and trochanteric support in accordance with the teachings of the present invention.

FIGS. 7-18 illustrate system for support of a body part of a patient turning and repositioning of the patient with simultaneous offloading of the bony prominences 300 in accordance with the teachings of the present invention. System 300 includes ultra low pressure plenum 312, as shown in FIG. 7. Ultra low pressure plenum 312 is configured to a shape to fit underneath a patient and support the lower back and/or hips of a patient. For example, ultra low pressure plenum 312 can have a width W of approximately 52 inches, and a height H of about 35 inches. Alternatively, width W can be a width of a bed, such as a hospital bed. Ultra low pressure plenum 312 can include upper bladder 314 and extension bladder 315. Extension bladder 315 extends from upper bladder 314. Extension bladder 315 and upper bladder 314 can be integral to one another. Air pressure within upper bladder 314 and extension bladder 315 is reduced sufficiently for distributing pressure within ultra low pressure plenum 312, but is not providing support of the received body part by itself.

Ultra low pressure plenum 212 can have a pressure of about 20 mm of water through about 5 mm of water in some cases even lower pressures can be used.

For example, the pressure in ultra low pressure plenum 312 can be below 20 mm of water. It will be appreciated that all equivalents such as mm Hg and PSI can be used for measuring the pressure within ultra low pressure plenum 312.

The pressure within ultra low pressure plenum 312 can be below about 20 mm of water if no positioner 23 is used or if an area of less than about 30% of ultra low pressure plenum 212 is covered by positioner 23. The pressure within ultra low pressure plenum 312 can be below about 10 mm of water if an area of between about 30% to about 60% of ultra low pressure plenum 312 is covered by positioner 23. The pressure within ultra low pressure plenum 312 can be below about 5 mm of water if an area of greater than about 60% of ultra low pressure plenum 312 is covered by positioner 23.

Figure 8:
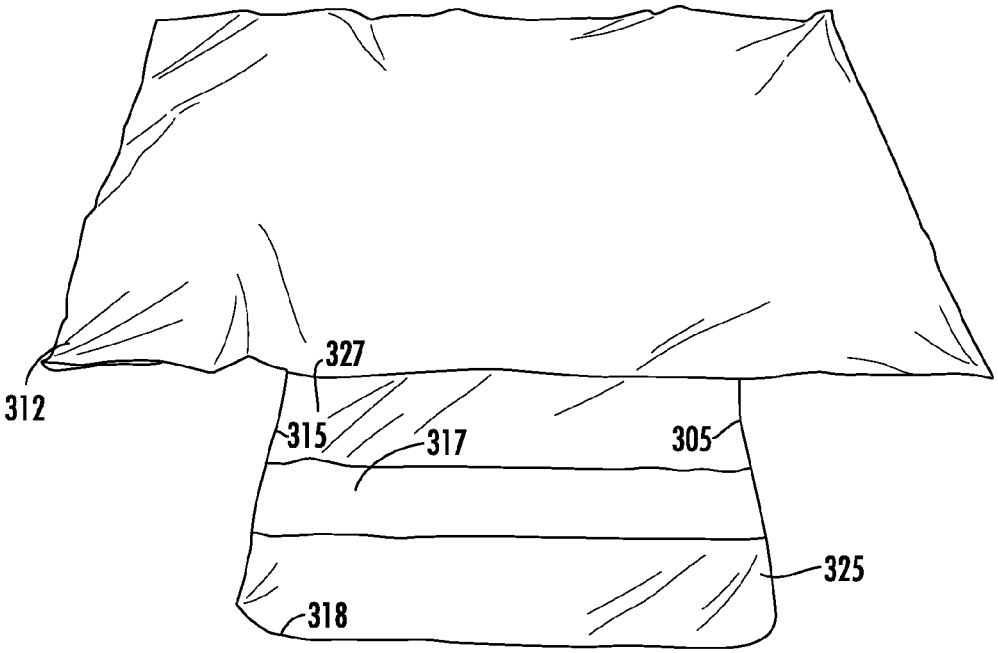
FIG. 8 is a front view of a cover placed over the support shown in FIG. 7.
Figure 9:
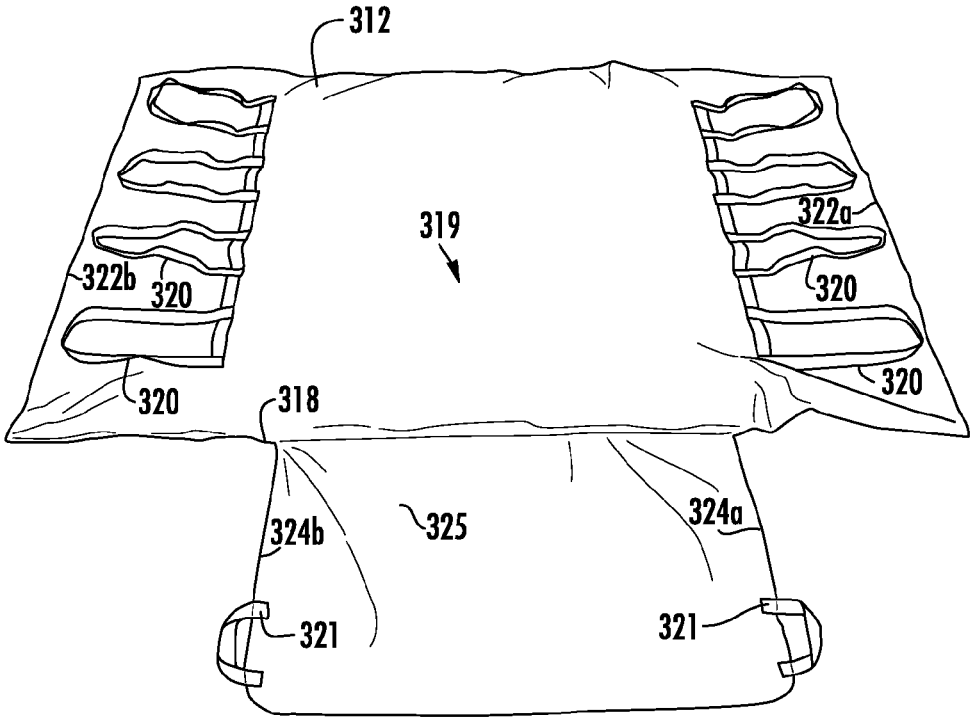
FIG. 9 is a rear view of a cover placed over the support shown in FIG. 7.
Figure 10:
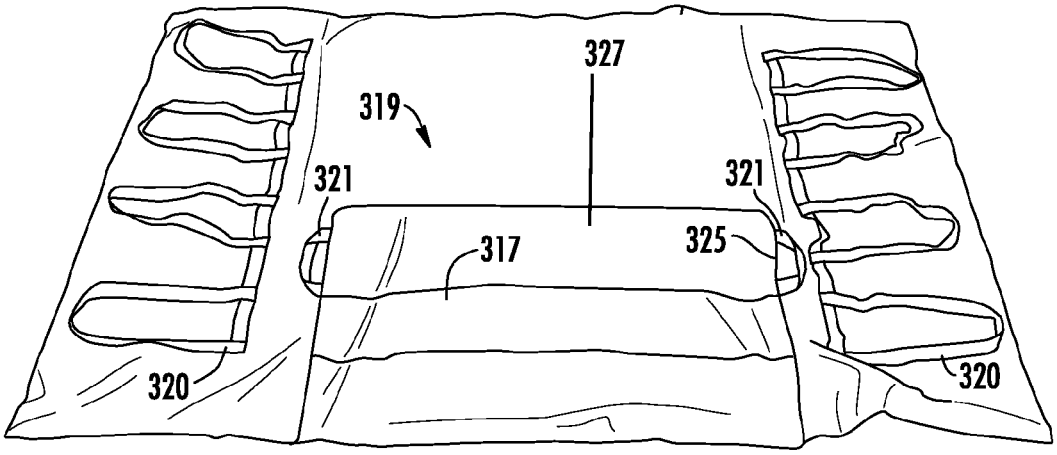
FIG. 10 is a rear view of a cover placed over the support shown in FIG. 7 including an extension of the support placed in a folded condition.

Cover 318 can be placed around ultra low pressure plenum 312, as shown in FIGS. 8-10. Cover 318 can be formed of a material having a low coefficient of friction to allow received ultra low pressure plenum 312 to be used to move a patient on a surface underneath ultra low pressure plenum 312. A suitable material having a low coefficient of friction is nylon or rip stop nylon material. Extension 325 of cover 318 receives extension bladder 315.

Portion 317 on upper surface 327 of extension 325 can be formed of a material having a high coefficient of friction. A suitable material having a high coefficient of friction is a rubberized or non-skid material. Portion 317 can be folded underneath rear surface 319 of upper bladder 314 to prevent movement of ultra low pressure plenum 312, as shown in FIG. 10. Handles 320 can be provided adjacent either edge 322*a*, 322*b* of cover 318 to aid in movement of ultra low pressure plenum 312. Handles 321 can be provided adjacent either edge 324*a*, 324*b* of extension 325 of cover 318 to aid in folding of extension 325 underneath rear surface 319.

Figure 11:
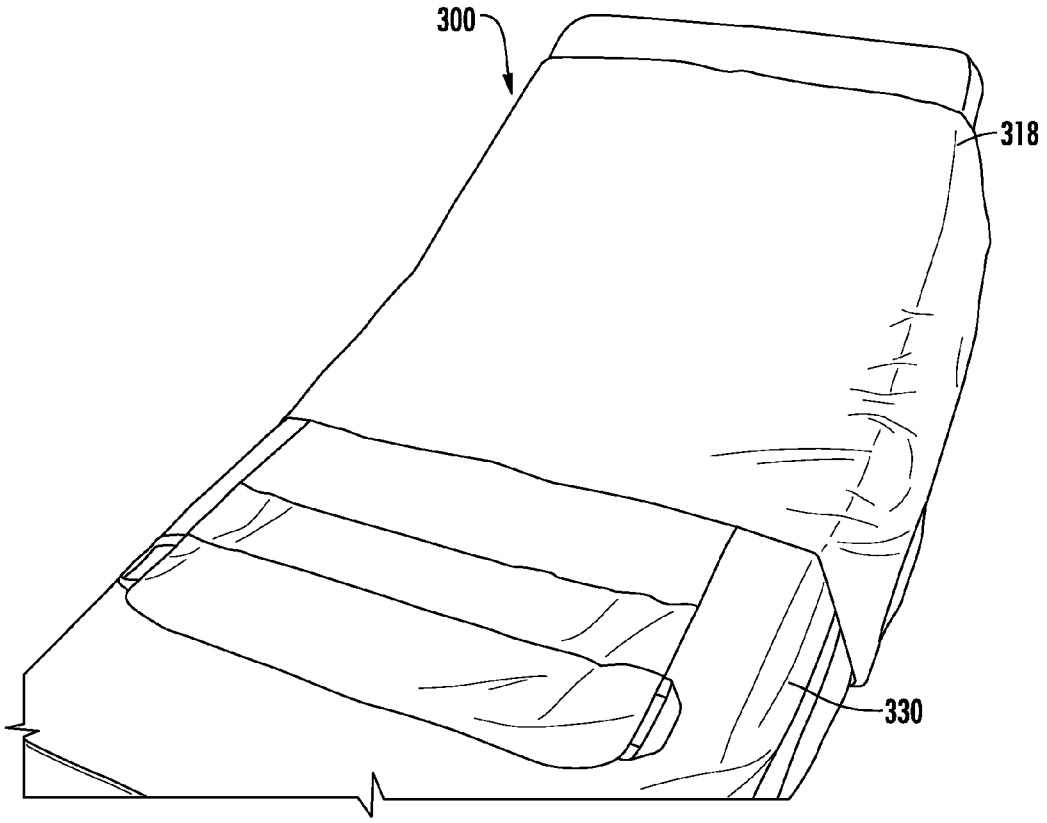
FIG. 11 is a schematic diagram of the system for sacral and trochanteric support in accordance with the teachings of the present invention when placed on a bed.
Figure 12:
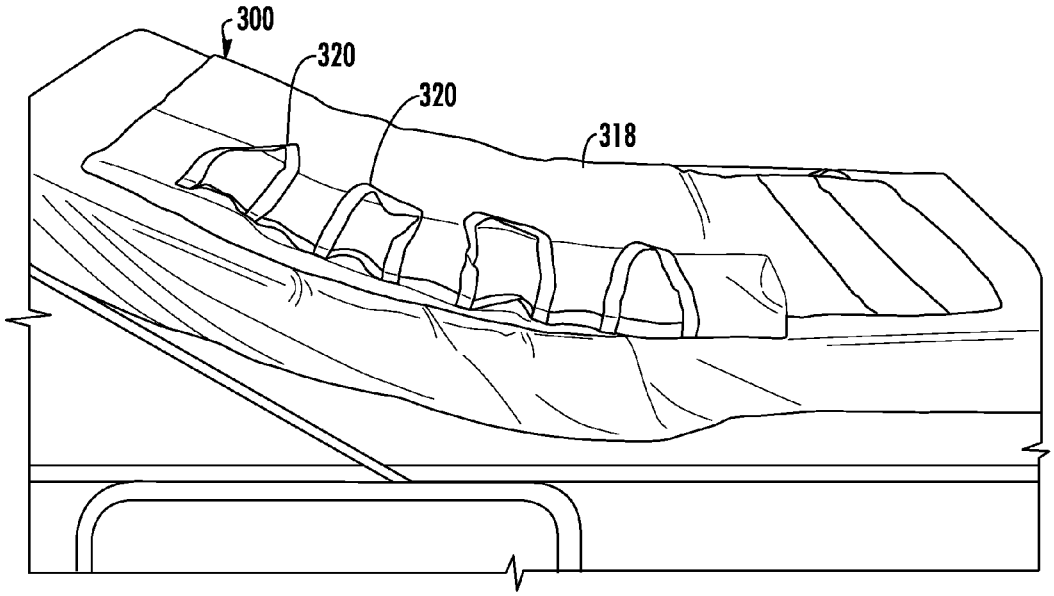
FIG. 12 is a schematic diagram of the system for sacral and trochanteric support in accordance with the teachings of the present invention when placed on a bed and having one side folded to expose handles attached to a rear side of the support.

FIGS. 11-18 illustrate use of system for support of a body part of a user turning and repositioning of the user with simultaneous offloading of the bony prominences 300. In FIG. 11, system for support of a body part of a user turning and repositioning of the user with simultaneous offloading of the bony prominences 300 can be placed on bed 330. System 300 can be moved to different positions on bed 330 using handles 320, as shown in FIG. 12.

Figure 13:
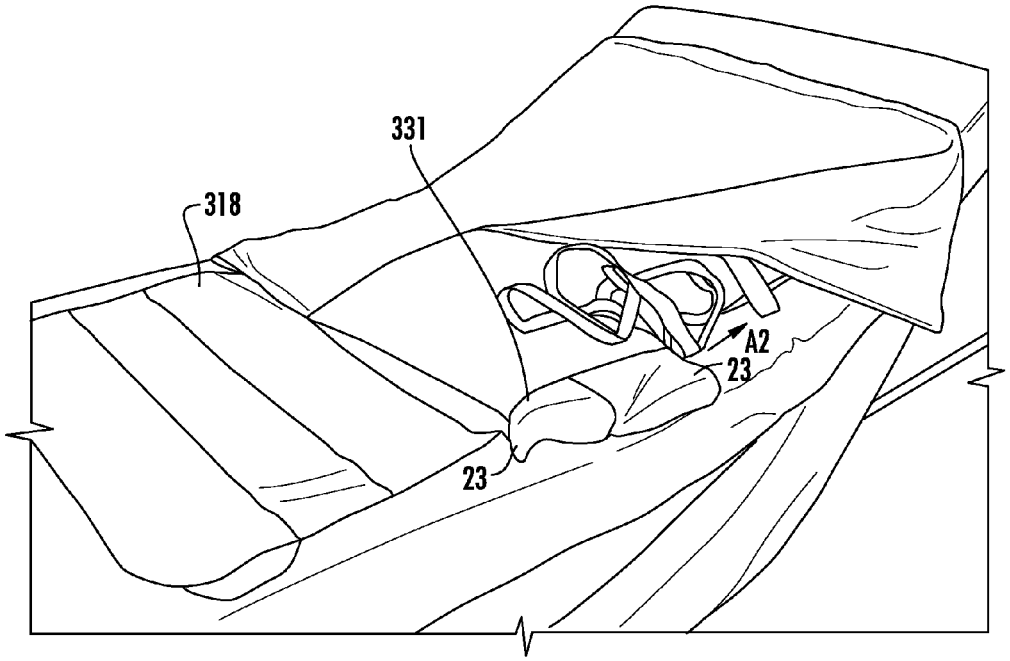
FIG. 13 is a schematic diagram of the system for sacral and trochanteric support in accordance with the teachings of the present invention when placed on a bed and including a positioner placed in a retainer of the cover.
Figure 14:
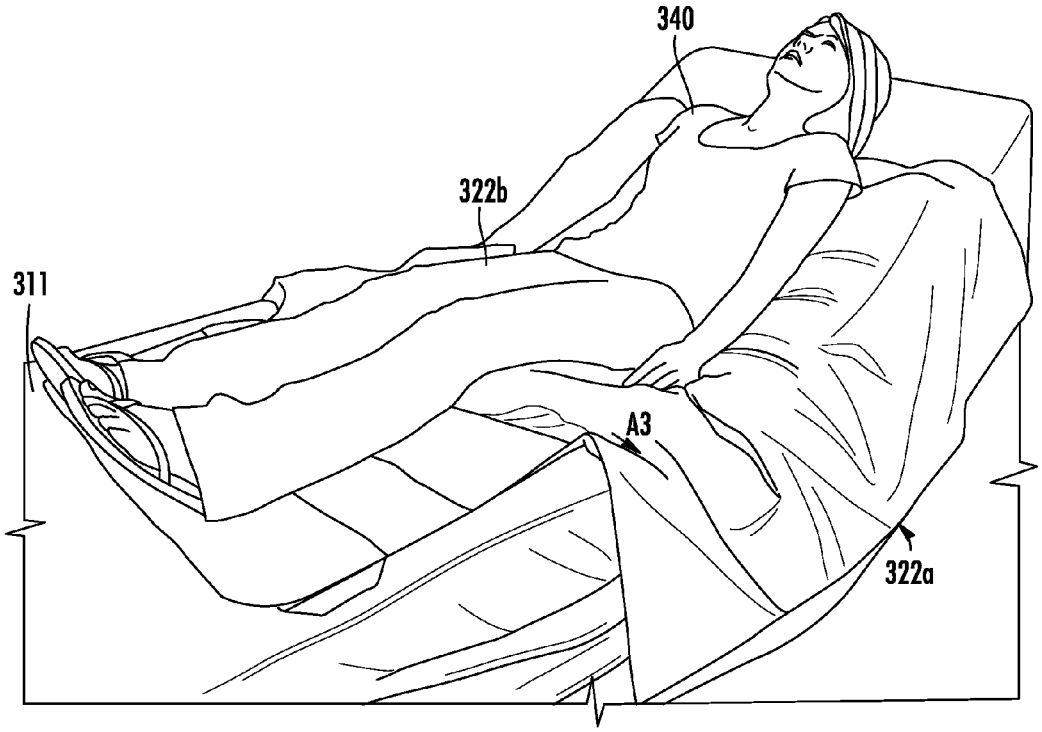
FIG. 14 is a schematic diagram of the system for sacral and trochanteric support in accordance with the teachings of the present invention when placed on a bed and in use by a user.
Figure 15:
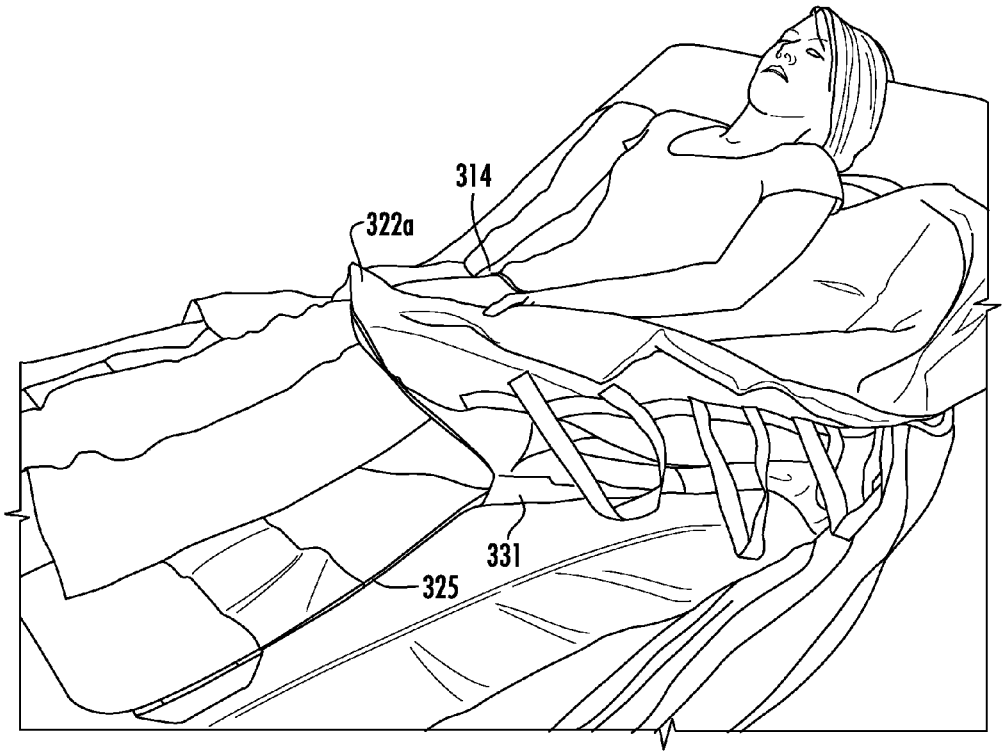
FIG. 15 is a schematic diagram of the system for sacral and trochanteric support in accordance with the teachings of the present invention when placed on a bed and in use by a user during folding of an edge towards the user.
Figure 16:
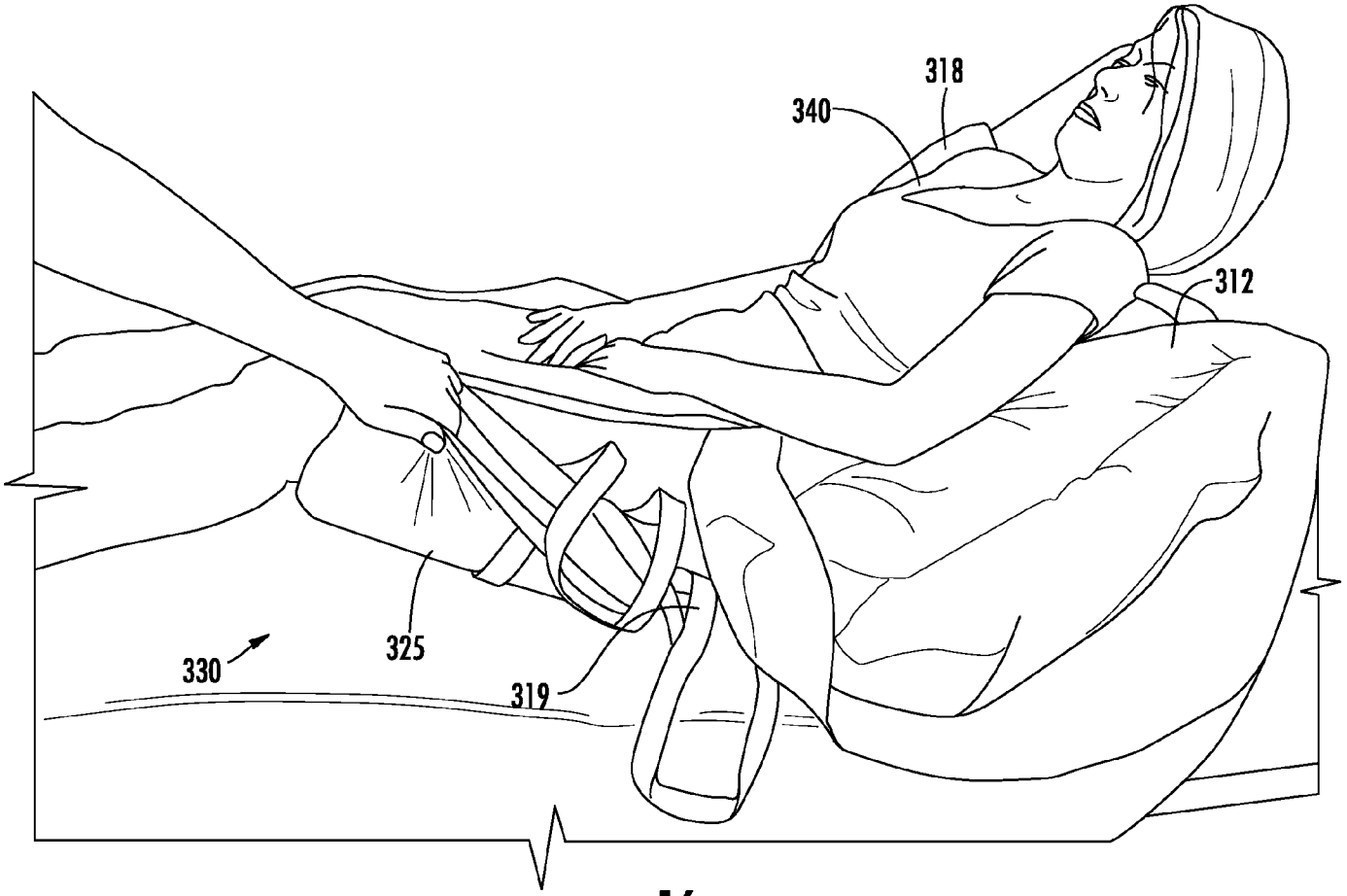
FIG. 16 is a schematic diagram of the system for sacral and trochanteric support in accordance with the teachings of the present invention when placed on a bed and in use by a user during folding of an extension of the cover and support.

Positioner 23 can be placed within pocket 331 of cover 318 to retain positioner 23. Positioner 23 can be placed over upper bladder 314 of ultra low pressure plenum 312 to displace gas in the direction of arrow $A_2$, as shown in FIG. 13. When a user is recumbent on ultra low pressure plenum 312 with their sacrum received on positioner 23, gas will be displaced in upper bladder 314 in the direction of arrow $A_3$ towards outer edges 322*a*, 322*b* for providing support adjacent to edges 322*a* and 322*b* thereby providing support of the user within edges 322*a* and 322*b* and lifting user 340 from surface 311 of bed 330 and offloading the sacrum and trochanter of user 340, as shown in FIG. 14. Additional positioners 23 can be placed in pocket 331 of cover 118 by lifting edge 322*a* to provide additional displacement of gas within upper bladder 314 as shown in FIG. 15. Extension 325 can be folded underneath rear surface 319 of upper bladder 314 to prevent movement of ultra low pressure plenum 312, as shown in FIG. 16.

Figure 17:
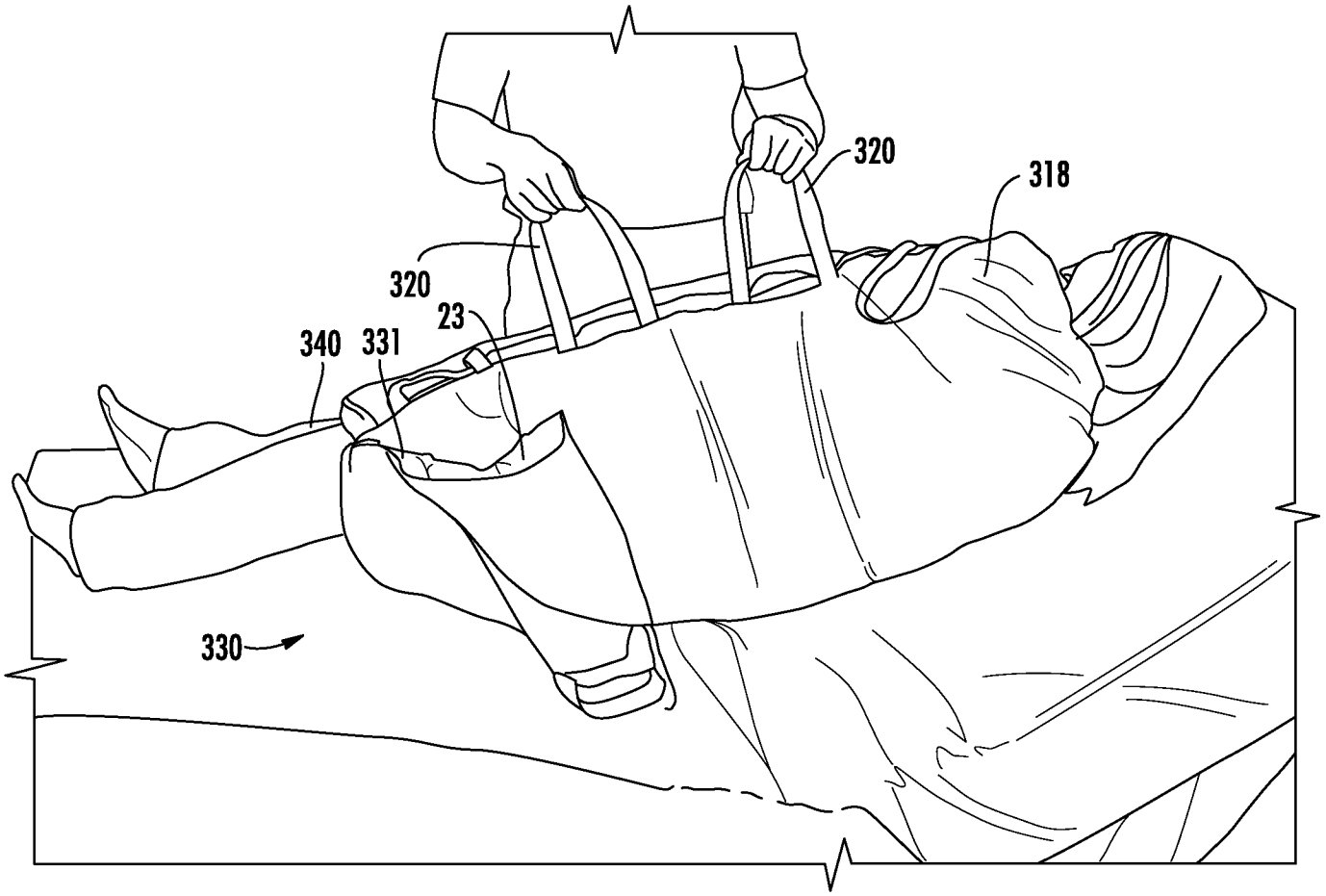
FIG. 17 is a schematic diagram of the system for sacral and trochanteric support in accordance with the teachings of the present invention when placed on a bed and in use by a user during turning of the user.
Figure 18:
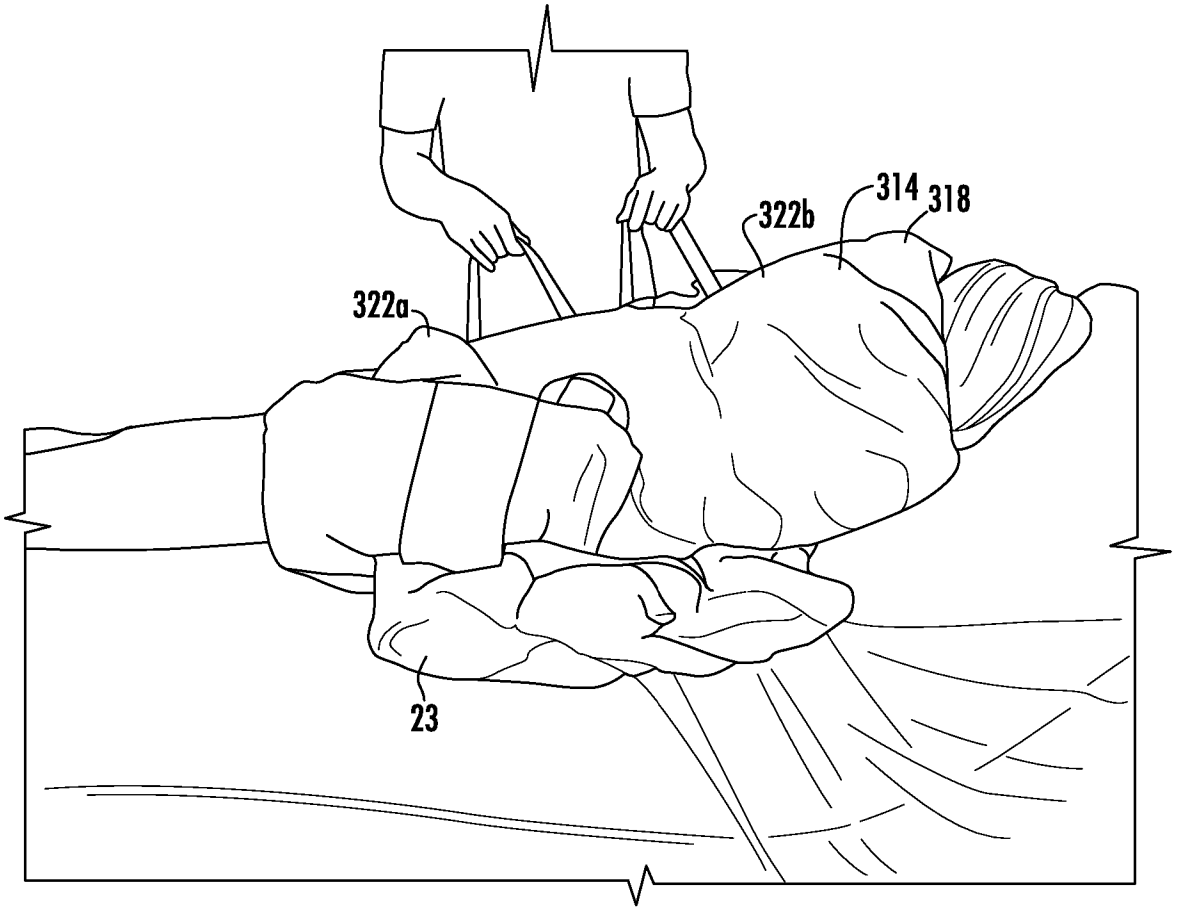
FIG. 18 is a schematic diagram of the system for sacral and trochanteric support in accordance with the teachings of the present invention when placed on a bed and in use including use of a positioner to aid in turning.

In one embodiment, user 340 can be moved or turned by using handles 320, as shown in FIG. 17. In one embodiment, positioner 23 can be positioned behind a side of cover 318 to push gas away from edges 322*a*, thereby aiding in turning of a user towards the opposite edge, as shown in FIG. 18. For example, if the patient is to be turned towards edge 322*b*, positioner 23 can be placed at edge 322*a* for displacing gas behind the patient to towards edge 322*b* of upper bladder 314, thereby pneumatically assisting in turning of the patient to face edge 322*b*.

Figure 19:
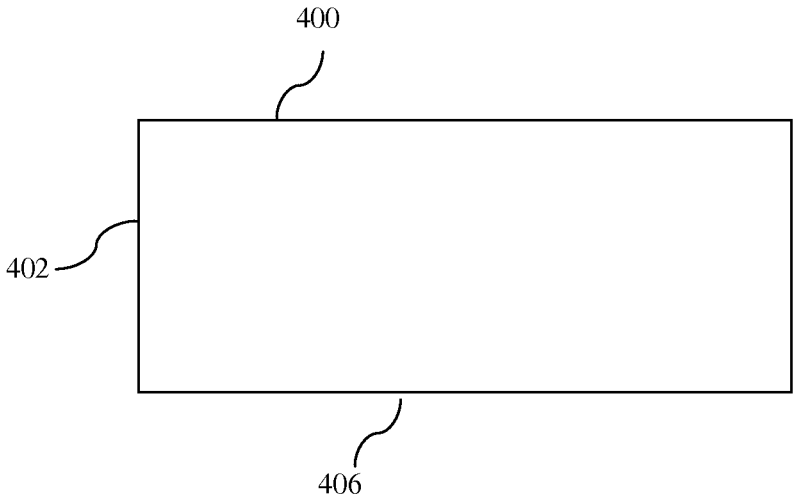
FIG. 19 is a schematic diagram of an alternate embodiment of a positioner used in the system for sacral and trochanteric support.

In one embodiment, positioner 400 can include ultra low pressure bladder 402, as shown in FIG. 19. The pressure within ultra low pressure bladder 402 is a range of less than about 20 mm of water to about 5 mm of water or a range of less than about 10 mm of water to about 5 mm of water. It will be appreciated that all equivalents such as mm Hg and PSI can be used for measuring the pressure within ultra low pressure bladder 402. In this embodiment, positioner 400 is formed with sufficient size and shape to displace an amount of gas in ultra low pressure bladder 402 to offload pressure from the received body part, such as the bony prominences of the sacrum and trochanter. Lower surface 406 of positioner 400 can be formed of a high friction material for preventing movement of positioner 400 over ultra low pressure plenum 12. Positioner 400 can be placed on top of ultra low pressure plenum 12 or beneath ultra low pressure plenum 12.

Positioner 400 can be placed over lower bladder 16 of ultra low pressure plenum 12 to displace gas from lower bladder 16 to upper bladder 14 in the direction of arrows $A_1$, as shown in FIG. 3.

In one embodiment, positioner 23 can be used together with positioner 400. Positioner 400 can be placed over lower bladder 16 of ultra low pressure plenum 12 positioner 23 can be positioned at one of edges 13*b* and 13*d* to push air away from respective edges 13*b* and 13*d* thereby aiding in turning of a patient towards the opposite edge, similar to positioner 23 as shown in FIG. 4. For example, if the patient is to be turned towards edge 13*d*, positioner 23 can be placed at edge 13*b* for displacing gas behind the patient to towards edge 13*b* of upper bladder 14, thereby pneumatically assisting in turning of the patient to face edge 13*d*.

It is to be understood that the above-described embodiments are illustrative of only a few of the many possible specific embodiments, which can represent applications of the principles of the invention. Numerous and varied other arrangements can be readily devised in accordance with these principles by those skilled in the art without departing from the spirit and scope of the invention.

What is claimed is:

1. A system for patient turning and positioning, comprising:

a plenum comprising a fixed amount of static gas therein, the plenum comprising an upper bladder having a first width configured to a shape to fit underneath a patient's back and an extension bladder having a second width that is smaller than the first width, at least one first set of gripping handles configured to be located at an edge of the upper bladder and at least one second set of gripping handles configured to be located at an edge of the extension bladder, wherein the at least one second set of gripping hands allows the extension bladder to be folded underneath the upper bladder.

2. The system of claim 1, further comprising a cover configured to receive the plenum, wherein the at least one first and second sets of gripping handles are attached to the cover.

3. The system of claim 2, wherein at least a portion of the cover that receives the extension bladder comprises a higher coefficient of friction than at least a portion of the cover that receives the upper bladder.

4. The system of claim 2, wherein the cover comprises a first surface having a first coefficient of friction and a second surface having a second coefficient of friction.

5. The system of claim 4, wherein the first coefficient of friction is different from the second coefficient of friction.

6. The system of claim 1, wherein gripping at least one handle of the first set of gripping handles creates a sling that allows a patient positioned on the plenum to be turned or moved.

7. The system of claim 1, wherein the at least one first set of gripping handles comprises a plurality of handles positioned along left and right sides of the upper bladder.

8. The system of claim 1, wherein the at least one second set of gripping handles comprises at least one handle positioned along a left side of the extension bladder and at least one handle positioned along a right side of the extension bladder.

9. The system of claim 1, wherein the plenum comprises a profile configured to be positioned underneath sheets of a bed.

10. The system of claim 1, wherein the fixed amount of static gas in the plenum comprises a constant pressure below about 20 mm of water.

11. The system of claim 1, wherein the fixed amount of static gas in the plenum comprises a constant pressure below about 5 mm of water.

12. The system of claim 1, further comprising a positioner configured to be positioned beneath the plenum in use.

13. The system of claim 1, wherein, in a first configuration, the extension bladder is coplanar with the upper bladder, and wherein, and a second configuration, the extension bladder is folded underneath at least a portion of the upper bladder.

14. The system of claim 1, wherein the upper bladder is configured to be positioned beneath a patient's back and were in the extension bladder is configured to be positioned beneath a patient's legs.

15. The system of claim 1, wherein the extension bladder comprises a higher coefficient of friction than at least a portion of the upper bladder.

16. The system of claim 1, wherein the plenum comprises a first surface having a first coefficient of friction and a second surface having a second coefficient of friction.

17. The system of claim 1, wherein the at least one first set of gripping handles is configured to be positioned along a rear surface of the plenum.

18. The system of claim 2, wherein the at least one first set of gripping handles is configured to be positioned along a rear surface of the cover.

* * * * *